US010905299B2

(12) United States Patent
Sauer et al.

(10) Patent No.: US 10,905,299 B2
(45) **Date of Patent: *Feb. 2, 2021**

(54) RETAINING PLATE WITH IMPROVED SEALING

(71) Applicant: Eurofilters Holding N.V., Overpelt (BE)

(72) Inventors: Ralf Sauer, Overpelt (BE); Jan Schultink, Overpelt (BE)

(73) Assignee: EUROFILTERS HOLDING N.V., Overpelt (BE)

( * ) Notice: Subject to any disclaimer, the term of this patent is extended or adjusted under 35 U.S.C. 154(b) by 193 days.

This patent is subject to a terminal disclaimer.

(21) Appl. No.: 16/085,351

(22) PCT Filed: Mar. 16, 2017

(86) PCT No.: PCT/EP2017/056251

§ 371 (c)(1),
(2) Date: Sep. 14, 2018

(87) PCT Pub. No.: WO2017/158098

PCT Pub. Date: Sep. 21, 2017

(65) Prior Publication Data

US 2019/0038096 A1 Feb. 7, 2019

(30) Foreign Application Priority Data

Mar. 17, 2016 (EP) ..... 16160967

(51) Int. Cl.
*A47L 9/14* (2006.01)

(52) U.S. Cl.
CPC ..... *A47L 9/1454* (2013.01)

(58) Field of Classification Search
CPC ..... A47L 9/1436; A47L 9/1445; A47L 9/1454
See application file for complete search history.

(56) References Cited

U.S. PATENT DOCUMENTS

2007/0175817 A1 8/2007 Goldman
2009/0223190 A1 9/2009 Nauta et al.
(Continued)

FOREIGN PATENT DOCUMENTS

CN 101747596 A 6/2010
DE 1 628 582 2/1968
(Continued)

OTHER PUBLICATIONS

Lueger; Encyclopedia of the entire technology: Staple Fiber 600 (Neuschappe); downloaded from the Internet on Aug. 29, 2019 at http://www.zeno.org/Lueger-1904/A/Stapelfaser; 1920; including English translation.

(Continued)

*Primary Examiner* — Robert Clemente
(74) *Attorney, Agent, or Firm* — Brinks Gilson & Lione

(57) ABSTRACT

The invention relates to a retaining plate (2) for a vacuum cleaner filter bag, comprising a base plate in which a passage opening (3) is formed, and a sealing flap (5) for sealing the passage opening (3), wherein the sealing flap (5) is biased in the sealed position via an elastic element (7), wherein the elastic element (7) is arranged in front of the sealing flap (5) when viewed in the sealing direction; and wherein the elastic member (7) comprises an elastomer, or the elastic member (7) comprises a coil spring (9), wherein the coil spring (9) is at least partially enclosed by a sheath (10).

9 Claims, 2 Drawing Sheets

(56) References Cited

U.S. PATENT DOCUMENTS

2009/0272083 A1* 11/2009 Sauer ..... A47L 9/1454 55/373
2011/0030557 A1 2/2011 Brownstein et al.

FOREIGN PATENT DOCUMENTS

| | | | |
|---|---|---|---|
| DE | 90 16 939 | U1 | 5/1991 |
| DE | 44 15 350 | A1 | 11/1995 |
| DE | 296 15 163 | U1 | 1/1997 |
| DE | 2001 0049 | U1 | 10/2000 |
| DE | 199 19 809 | A1 | 11/2000 |
| DE | 199 48 909 | A1 | 4/2001 |
| DE | 102 03 460 | A1 | 8/2002 |
| DE | 10221694 | A1 | 12/2003 |
| DE | 20 2006 020 047 | U1 | 10/2007 |
| DE | 10 2006 037 456 | A1 | 2/2008 |
| DE | 10 2006 055 890 | A1 | 5/2008 |
| DE | 20 2008 003 248 | U1 | 6/2008 |
| DE | 20 2008 005 050 | U1 | 7/2008 |
| DE | 20 2008 004 733 | U1 | 11/2008 |
| DE | 10 2008 046 200 | A1 | 4/2009 |
| DE | 10 2007 062 028 | A1 | 6/2009 |
| DE | 20 2008 006 904 | U1 | 11/2009 |
| DE | 10 2008 041 227 | A1 | 2/2010 |
| DE | 20 2008 018 054 | U1 | 6/2011 |
| DE | 10 2010 060 175 | A1 | 3/2012 |
| DE | 10 2011 008 117 | A1 | 4/2012 |
| DE | 10 2010 060 353 | A1 | 5/2012 |
| DE | 10 2011 105 384 | A1 | 12/2012 |
| DE | 20 2013 001 096 | U1 | 4/2013 |
| DE | 20 2011 052 208 | U1 | 5/2013 |
| DE | 20 2013 100 862 | U1 | 5/2013 |
| DE | 10 2012 012 999 | A1 | 7/2013 |
| DE | 20 2013 103 508 | U1 | 10/2013 |
| DE | 10 2014 109 596 | A1 | 2/2015 |
| DE | 20 2015 101 218 | U1 | 5/2015 |
| DE | 20 2014 100 563 | U1 | 6/2015 |
| EP | 0 758 209 | A1 | 11/1995 |
| EP | 0 960 645 | A2 | 12/1999 |
| EP | 1 198 280 | A1 | 1/2001 |
| EP | 1 137 360 | A1 | 4/2001 |
| EP | 1 254 693 | A2 | 11/2002 |
| EP | 1258277 | A1 | 11/2002 |
| EP | 1 480 545 | A1 | 9/2003 |
| EP | 1 795 247 | A1 | 6/2007 |
| EP | 1 795 427 | A1 | 6/2007 |
| EP | 1917895 | B1 | 5/2008 |
| EP | 2004303 | B1 | 12/2008 |
| EP | 2 011 556 | A1 | 1/2009 |
| EP | 2 044 874 | A2 | 4/2009 |
| EP | 2 123 206 | A1 | 11/2009 |
| EP | 2 263 508 | A1 | 12/2010 |
| EP | 2 442 703 | A1 | 12/2010 |
| EP | 2 301 404 | A2 | 3/2011 |
| EP | 2 433 695 | A1 | 3/2012 |
| EP | 3 219 373 | A1 | 9/2017 |
| EP | 3 219 374 | A1 | 9/2017 |
| EP | 3 219 375 | A1 | 9/2017 |
| FR | 2 721 188 | A1 | 12/1995 |
| WO | WO 01/003802 | A1 | 1/2001 |
| WO | WO 03/073903 | A1 | 9/2003 |
| WO | WO 07/121979 | A1 | 11/2007 |
| WO | WO 11/047764 | A1 | 4/2011 |
| WO | WO 11/057641 | A1 | 5/2011 |
| WO | WO 13/106392 | A2 | 7/2013 |
| WO | WO 2014/074398 | A2 | 5/2014 |

OTHER PUBLICATIONS

International Search Report dated Aug. 23, 2017 for International Application No. PCT/EP2017/056251.

East Bavarian Technical College: construction course in plastics technology East Bavarian Technical University Amberg-Weiden; Study content for the course of plastics technology; downloaded from the internet on May 23, 2019 at https://www.oth-aw.de/studiengaenge-und-bildungsangbote/studienangebote/bachelor-studiengaenge/kunststofftechnik/aufbau/; 10 pages including English translation.

European Standard No. DIN EN 15347: Plastics, Recycled Plastics, Characterisation of Plastics Wastes, English Version; ICS 13.030.50; 83.080.01; Feb. 2008; 12 pages.

Shen, Li et al.; "Open-loop recycling: A LCA case study of PET bottle-to-fibre recycling"; Resources, Conservation and Recycling, vol. 55; Nov. 1, 2010; pp. 34-52.

* cited by examiner

RETAINING PLATE WITH IMPROVED SEALING

This application claims the benefit under 35 U.S.C. § 371 of International Application No. PCT/EP2017/056251, filed Mar. 16, 2017, which claims the priority of European Patent Application No. 16160967.2, filed Mar. 17, 2016, which are incorporated by reference herein in their entirety.

The invention relates to a retaining plate for a vacuum cleaner bag, in particular for arranging the vacuum cleaner filter bag within a vacuum cleaner housing.

Such retaining plates are known in a variety of forms. Many known retaining plates also feature sealing mechanisms, in which the passage opening can be sealed in the bag after use of the bag to prevent accidental leakage of suction material. Different solutions have been proposed for the sealing mechanism, such as sliding gate valve solutions in EP 0 758 209, hinge [or pivot] solutions in DE 10 2011 105 384 or membrane solutions in FR 2 721 188.

Solutions with so-called sealing flaps often use spring elements, which press or pull the sealing flaps into the sealing position after use. For instance, leaf springs, as disclosed in EP 2 123 206, curved leaf springs, as disclosed in EP 1 137 360, or helical steel springs, as disclosed in DE 10 2012 012 999, are applied. Other spring elements are known from DE 20 2013 100 862, DE 10 2008 046 200 and DE 10 2006 037 456.

The spring elements are often arranged inside the filter bag, as disclosed in DE 10 2011 008 117 or DE 20 2015 101 218, but they can also be arranged outside of the filter bag, as disclosed in EP 1 480 545.

Solutions with automatic sealing mechanisms have proven themselves liable to fail, in particular if they are in the dust chamber, i.e. within the filter bag, and if these coil springs are applied. The sealing function is therefore not always ensured. Often, the sealing flaps remain partially open.

Therefore, the object of the invention is to provide a retaining plate that has a functionally reliable solution for sealing the passage opening, which can also be cost-effectively realized in a large-scale production.

This object is achieved by a retaining plate according to claim 1. Particularly advantageous embodiments can be found in the dependent claims.

The inventors of the present application have recognized that problems concerning the sealing function in known retaining plates can often be attributed to the fact that dust or other foreign particles accumulate between the coils of coil springs, such that they can no longer sufficiently apply pressure to the sealing flap with the necessary spring force. The present invention prevents or reduces the deposits of dirt particles by using an elastic element comprising an elastomer instead of a coil spring. According to one alternative, a coil spring is used; however, the coil spring is at least partially enclosed by a sheath. Both alternatives prevent, or at any rate, reduce the possibility of dirt particles accumulating between the coils of a coil spring. This improves the functional reliability of the sealing mechanism, while the solution is also easy to realize, such that it can also be implemented cost-effectively in a large-scale production.

Here a coil spring is understood to be a spring, in which the spring wire is wound up as a coil. Along the longitudinal axis, the shape of the spring can be cylindrical or conical (conical spring). Springs that include a coil spring, such as leg springs, are also to be regarded as coil springs. Coil springs are insofar to be distinguished from spiral springs, in which a metal strip curved in one plane is wound up helically or conchoidally.

The retaining plate can be attached to a retaining mechanism in a vacuum cleaner housing. Alternatively, the vacuum cleaner filter bag can be slidable by means of the retaining plate over a connecting piece on the vacuum cleaner side.

The sealing flap can be connected via a joint, in particular a film hinge, to parts of the retaining plate, in particular the base plate. The sealing flap can have a shape that corresponds to the shape of the passage opening.

The elastic element is arranged in front of the sealing flap when viewed in the sealing direction. In the opening direction, the elastic element is therefore arranged behind the sealing flap. Thus, in other words, the elastic element is arranged on the side of the retaining plate, which is intended for connection with the bag wall of the vacuum cleaner filter bag. If the retaining plate is connected to a vacuum cleaner filter bag, the elastic element is thus located in the dust compartment, i.e. inside the vacuum cleaner filter bag.

Since the elastic element is, in the assembled state of the retaining plate to a vacuum cleaner filter bag, directed towards the direction of the bag interior, the elastic element is completely inside the bag in the sealing position of the sealing flap. This has the advantage that suction material, which is disposed in the area of the elastic element, for example, in the area where the element is mounted on a part of the retaining plate, remains in the bag when it is, for example, removed from the vacuum cleaner.

A sheath can herein be in particular understood as an element that completely encloses the coil spring radially and extends along the longitudinal axis of the coil spring.

In particular, the sheath may be in the form of a tube, whereby the coil spring is located at least partially inside the tube. The sheath can be designed particularly in the form of a hollow cylinder. The sheath can be open or closed on the cover surfaces. A closed design of the sheath improves the protection of the coil spring against dirt particles.

However, the sheath does not have to be formed as a hollow cylinder. It is also possible for a cavity or a pocket to be formed by the sheath, in which the coil spring is arranged.

The sheath may comprise a plastic, a nonwoven fabric and/or paper. A fabric tape can also be used. The plastic for the sheath can in particular be an elastomer, in particular a thermoplastic elastomer (TPE). The elastomer may also comprise or be vulcanized silicone elastomer Crosslinked liquid silicone (liquid silicone rubber, LSR) or crosslinked solid silicone (high consistency rubber, HCR) are particularly suitable.

The sheath can comprise two films, which are connected on at least two sides, whereby a pocket is formed in which the coil spring is arranged. Such a sheath is particularly easy to manufacture.

Alternatively, the sheath can also comprise a film, of which at least two opposite edges are joined together, whereby a pocket is formed in which the coil spring is arranged. In this case, the opposite edges can be joined by a weld seam. Since only one film is used, the relative arrangement of two films to each other can be omitted, so that the production of the wrapping is simplified even further.

To seal the film, in particular an ultrasonic welding technique can be applied.

In the alternative case of an elastic element comprising an elastomer, the elastomer may in particular comprise or be vulcanized silicone elastomer. Crosslinked liquid silicone rubber (LSR) or crosslinked solid silicone (High-Consistency Rubber, HCR) are particularly suitable.

The elastic element can also consist of an elastomer. This enables a particularly simple design of the elastic element.

The elastic element can be molded onto a part of the retaining plate, in particular the base plate. This allows a simple connection of the elastic element with the retaining plate.

The elastic element comprising an elastomer can be cylindrical. The base area can be rectangular or circular. However, other surface areas are also conceivable. The geometry of the elastic element can be adapted to the geometry of the retaining plate.

The elastic element can be arranged at least partially exposed on the retaining plate. A covering by a separate cover element is therefore not necessary.

The elastic element can be connected to the retaining plate, in particular the base plate and/or the sealing flap, in different ways. For example, the elastic element can be fastened in a positive or non-positive manner. The elastic element can, for example, be clamped to the retaining plate. As mentioned above, injection molding of the elastic element is also possible.

In particular, one end of the elastic element may be connected to a part of the support plate, in particular the base plate, while a second end rests loosely on a part of the retaining plate, in particular the base plate. This can particularly be the case with a cylindrical elastic element.

The elastic element can also rest loosely on the retaining plate. In this case, a cover element may be provided that limits the position of the elastic element to a predetermined range. The cover element can be used in conjunction with the base plate and/or the sealing flap to define a volume, within which the elastic element is partially or completely arranged.

The elastic element can also be designed and/or arranged in such a way that it is subjected to bending stress when the sealing flap is opened. In other words, a bending moment can act on the elastic element when the sealing flap is opened.

The retaining plate can be an injection-molded part. However, the retaining plate can also be produced at least in part by a thermoforming process (deep-drawing, vacuum deep-drawing). The retaining plate can also be at least partially punched.

The retaining plate described above can be formed as one piece or multiple pieces. For example, the retaining plate may comprise a retaining mechanism and a separate sealing mechanism comprising the sealing flap. The sealing device can be connected directly or indirectly to the retaining mechanism, for example via the bag wall of the vacuum cleaner filter bag and/or via a sealing membrane.

In the case of a multi-piece retaining plate, the base plate can also be multi-piece. For example, one part of the base plate may be part of the retaining mechanism, and another part may be part of the sealing device.

The invention also provides a vacuum cleaner filter bag comprising a bag wall and a retaining plate as described above.

The retaining plate can therefore have one or more of the features mentioned above.

The bag wall of the vacuum cleaner filter bag can comprise one or more layers of filter material, particularly one or more nonwoven layers. Vacuum cleaner filter bags with such a bag wall made of several layers of filter material are known, for example, from EP 2 011 556 or EP 0 960 645. A wide variety of plastics can be used as the material for the nonwoven layers, for example, polypropylene and/or polyester. Particularly, the layer of the bag wall that is to be connected to the retaining plate can be a nonwoven layer.

The term "nonwoven" is applied, according to the definition of the ISO Standard ISO9092:1988 or CEM Standard EN29092. In particular the terms "nonwoven" or "fleece" and "nonwoven fabric" are defined in the field of manufacturing nonwovens as follows and are likewise to be understood as such in the sense of the present invention. Fibers and/or filaments are used to produce a nonwoven fabric. The loose or loose and still unbound fibers and/or filaments are referred to as fleece or fiber fleece (web). By means of a so-called fleece-binding step, a nonwoven material of this type is finally produced, which has sufficient strength, for example, to be wound into rolls. In other words, a nonwoven is self-supporting due to bonding. (Details on the use of the definitions and/or processes described herein can also be found in the standard work *Vliesstoffe* [English: "Nonwoven Fabrics"] by W. Albrecht, H. Fuchs, W. Kittelmann, Wiley-VCH, 2000).

The bag wall may have a passage opening, where in particular the passage opening of the bag wall is aligned with the passage opening of the base plate. Through the passage opening in the base plate and the passage opening in the bag wall, an inlet opening can be formed through which the air to be cleaned can flow into the interior of the vacuum cleaner filter bag.

The invention also provides a method of manufacturing a retaining plate for a vacuum cleaner filter bag according to claim 11.

The provision of the base plate and the sealing flap may include, in particular the production of the base plate and the sealing flap by injection molding. It is also possible to form the base plate by deep-drawing (thermoforming) and/or punching. In this case, the sealing flap can be formed by injection molding as a separate element and then directly or indirectly connected to the deep-drawn and/or stamped base plate.

The arrangement of the elastic element on the base plate and/or the sealing flap may comprise a connection of the elastic element to the base plate and/or the sealing flap, in particular by ultrasonic welding, gluing, or by a non-positive or positive connection, for example, clamping.

The arrangement of the elastic element may comprise, in particular injection molding of the elastic element onto a part of the retaining plate, in particular the base plate and/or the sealing flap.

The arrangement of an elastic element may also include the arrangement of a coil spring on a foil. A second film can then be placed over the coil spring and at least two sides of the films can be joined together to form a pocket into which the coil spring is arranged. The pocket can be closed on one or both of the remaining sides by one or two cross-connections, in particular cross-weldings.

It is also possible, after placing the coil spring on the film, to connect two opposite edges of the film together, so that a pocket is formed in which the coil spring is arranged. The remaining open sides of the bag can be closed by cross-connections, especially cross-welding.

FURTHER FEATURES AND ADVANTAGES ARE DESCRIBED BELOW USING THE EXEMPLARY FIGURES

Thereby:

FIG. 1 schematically shows the construction of an exemplary vacuum cleaner filter bag;

Figure 1:
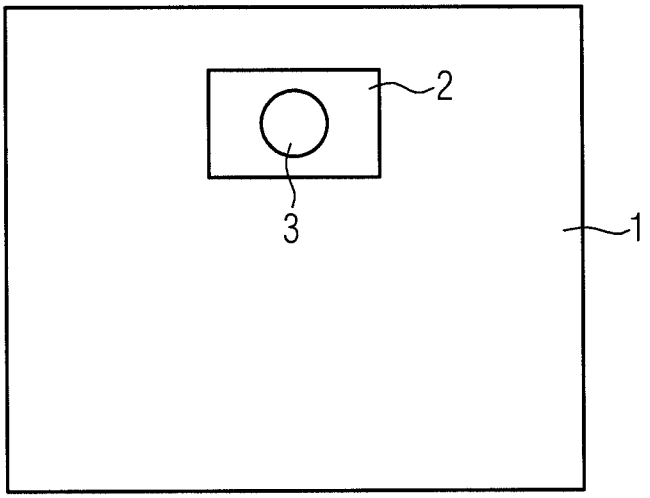

FIG. 1 shows the schematic structure of an exemplary vacuum cleaner filter bag. The filter bag comprises a bag wall 1, a retaining plate 2 and an inlet opening through which the air to be filtered flows into the filter bag. The inlet opening is formed here by a passage opening 3 in the base plate of retaining plate 2 and a passage opening in the bag wall 1 arranged in alignment therewith. The retaining plate 2 is used to fix the vacuum cleaner filter bag in a corresponding retaining mechanism in a vacuum cleaner housing.

The bag wall 1 comprises at least one nonwoven layer, for example, made of a melt-spun fine fibre nonwoven (melt-blown nonwoven) or a filament-spun nonwoven (spun bond).

The retaining plate 2 comprises a base plate made of a plastic material, for example, polypropylene.

Figure 2:
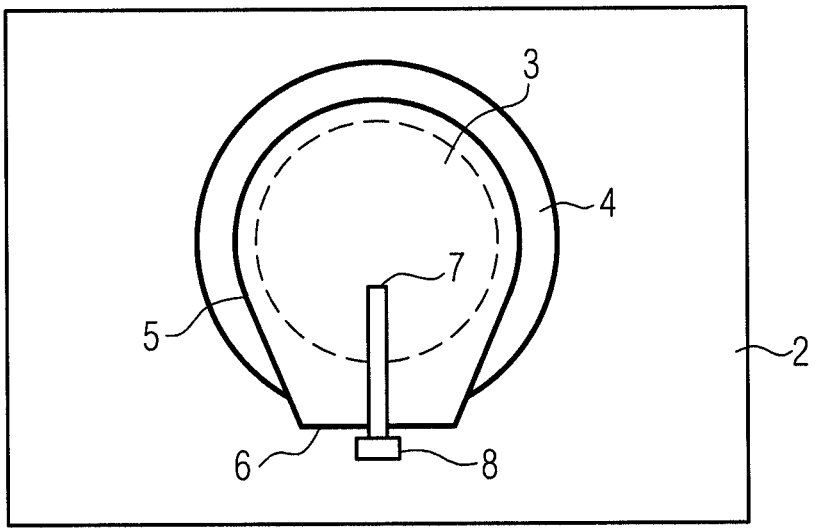
FIG. 2 shows the schematic structure of an exemplary retaining plate in a top view.

A top view of an exemplary retaining plate, which can be used in conjunction with a filter bag, as shown in FIG. 1, is shown in FIG. 2. It shows the retaining plate 2 with the passage opening 3. The base plate of retaining plate 2 is presented here as schematically rectangular, but it can have any shape that can correspond, in particular, with the corresponding retaining mechanism in the vacuum cleaner housing.

FIG. 2 also shows a sealing lip 4 enclosing the passage opening 3. The sealing lip 4 may comprise a thermoplastic elastomer, for example, based on polypropylene, or consist of it. The sealing lip 4 is designed to prevent or limit the escape of dust from the vacuum cleaner filter bag by sealing the area between the inner edge of the passage opening 3 and the outside of a connection piece of the vacuum cleaner. However, the sealing lip shown here is only optional. It is also conceivable that the bag material of the vacuum cleaner filter bag itself could be used as a sealing ring, as disclosed, for example, in DE 102 03 460. It is also possible to use a sealing membrane between retaining plate 2 and bag wall 1, as disclosed in EP 2 044 874. It is also possible that no sealing is provided.

FIG. 2 also shows a sealing flap 5, which can be pivoted around a joint 6. The hinge 6, in particular can be a film hinge. The sealing flap 5 seals the opening 3 when the vacuum cleaner is not in use, in particular when the filter bag is removed from the vacuum cleaner.

The sealing flap 5 is biased by an elastic element 7 in the sealing position. The elastic element 7 is connected to the base plate of the support plate 2 in the area of a bearing 8. In this example, the elastic element 7 is arranged in front of the sealing flap 5 when viewed in the sealing direction. The top view of FIG. 2 is therefore on the side of the retaining plate 2, which is to be connected to the bag wall 1. After connecting the retaining plate 2 with the vacuum cleaner filter bag, the elastic element 7 is therefore located in the dust chamber, i.e. inside the filter bag.

The elastic element 7 can be, for example, an elastomer element in particular made of a vulcanized silicone elastomer (for example crosslinked liquid silicone rubber (LSR) or crosslinked solid silicone (High-Consistency Rubber, HCR)). When the sealing flap 5 is pivoted around the joint 6 into an open position, the elastic element 7 is compressed and/or deflected in such a way that a resetting spring force is produced, which is applied to the sealing flap 5. If the vacuum cleaner filter bag is removed, for instance, from the vacuum cleaner housing, the force opening the sealing flap 5 ceases to exist, and the sealing flap 5 is returned to the closed position via the elastic element 7.

The elastic element 7 in this example is cylindrical, in particular with a rectangular base (not shown). At position 8, the elastic element 7 is molded onto the base plate of the retaining plate 2. This can be achieved by means of two-component injection molding. If a sealing lip 4 is provided, as in this example, the elastic element 7 and the sealing lip 4 can be molded together on the base plate into one mold. In this case, the elastic element 7 and the sealing lip 4 can be made of the same material.

Figure 3:
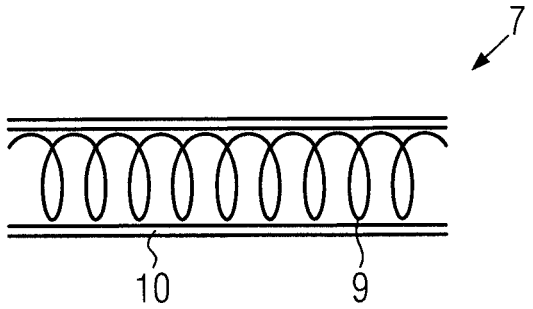
FIG. 3 shows an illustration of the example elastic elements.

FIG. 3 shows an alternative elastic element 7 in a schematic representation. In particular, FIG. 3 shows a coil spring 9, which is arranged inside a sheath 10. For illustrative purposes, the sheath 10 is shown in a longitudinal section. In fact, the sheath 10 completely encloses the coil spring 9 radially. In other words, the sheath 10 in this example is formed as a hollow cylinder. Sheath 10 protects the spaces between the coil spring 9 from dirt particles, such that the spring effect is not, or to a lesser extent, impaired by dirt particles. The ends of the sheath 10 can be open, as illustrated in FIG. 3. Alternatively, it is also possible to seal one or both ends of the hollow cylinder so that the coil spring 9 is more or completely shielded from the environment. This prevents the coil spring 9 from being exposed to dirt particles as much as possible.

Figure 4A:
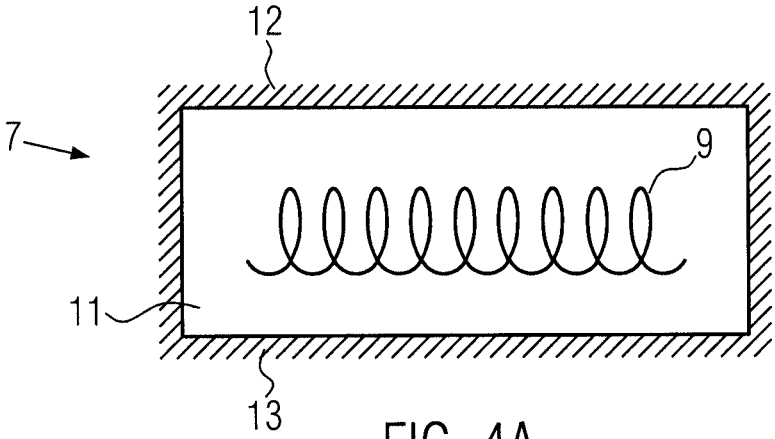
FIGS. 4A and 4B show alternative examples of a possible elastic element.
Figure 4B:
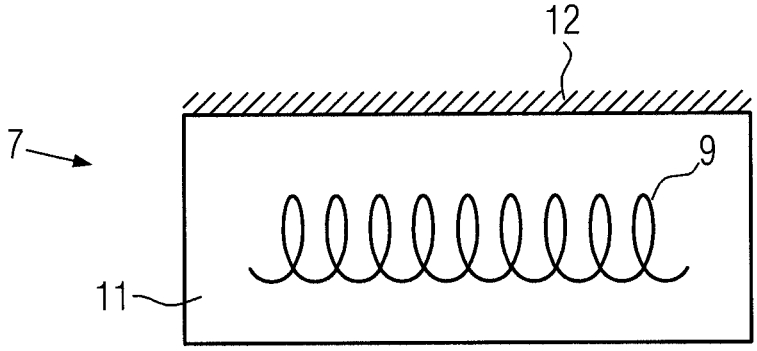

FIGS. 4A and 4B show alternative possibilities for the sheath 10 of FIG. 3. FIG. 4A again shows a coil spring 9, this time in a top view. The coil spring 9 lies on a film not shown here and is covered by another film 11. The coil spring 9 is therefore located between two films, which are arranged on top of one another. In the example in FIG. 4A, the two films are completely welded together. The weld seams 12 and 13 are arranged on two opposite sides of the films. This creates a cavity or a pocket, in which the coil spring 9 is arranged. This pocket is sealed at the ends by further cross-weld seams. As a result, the coil spring is completely shielded from the environment. The films in this example are plastic films. Welding is carried out by applying a ultrasonic welding technique.

FIG. 4B shows an alternative in which only one film 11 is used, on which the coil spring 9 is first arranged. Part of the film 11 is then folded over the coil spring 9 and two opposite edges of film 11 are joined together with a longitudinal weld seam 12. This in turn creates a cavity or pocket, in which the coil spring 9 is arranged. In the example in FIG. 4B, the ends of this bag are open. However, it would also be possible to seal the two ends with a transverse weld seam, in accordance with FIG. 4A.

Figure 5A:
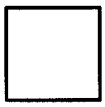
FIGS. 5A, 5B and 5C show different cross-sections of exemplary elastic elements.
Figure 5B:
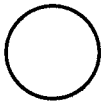
Figure 5C:
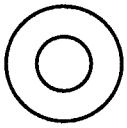

FIGS. 5A, 5B and 5C show different cross-sections of an elastic element made of an elastomer. FIG. 5A shows a square cross-section, FIG. 5B shows a circular cross-section, and FIG. 5C shows an annular cross-section. However, other geometries of the cross-section are also conceivable.

It goes without saying that the features mentioned in the exemplary embodiments described above are not limited to these special combinations and are also possible in any other combinations. Furthermore, it goes without saying that neither the vacuum cleaner filter bag shown nor the elements of the retaining plate are realistically dimensioned in the figures. In addition, the geometries or the elements shown are not limited to the examples shown.

The invention claimed is:

1. A retaining plate for a vacuum cleaner filter bag, comprising a base plate, wherein a passage opening is formed, and a sealing flap for sealing the passage opening, wherein the sealing flap is biased by an elastic element in a closed position, and wherein the elastic element is arranged in front of the sealing flap when viewed in a sealing direction; and wherein the elastic element comprises a coil spring, wherein the coil spring is at least partially enclosed by a sheath.

2. The retaining plate according to claim 1, wherein the sheath comprises a plastic, a nonwoven, a paper or combinations thereof.

3. The retaining plate according to claim 2, wherein the sheath comprises two films joined together on at least two sides to form a pocket, in which the coil spring is arranged.

4. The retaining plate according to claim 2, wherein the sheath comprises a film, of which at least two opposite edges are joined together to form a pocket, in which the coil spring is arranged.

5. The retaining plate according to claim 1, wherein one end of the elastic element is connected to a part of the retaining plate, and a second end rests loosely against a part of the retaining plate.

6. The retaining plate according to claim 1, wherein the elastic element is designed or arranged or both designed and arranged such that the elastic element is subjected to bending stress when the sealing flap is opened.

7. The retaining plate according to claim 1, wherein one end of the elastic element is connected to the base plate, and a second end rests loosely against the base plate.

8. A vacuum cleaner filter bag comprising a bag wall and a retaining plate according to claim 1, the retaining plate connected to the bag wall.

9. A method of manufacturing a retaining plate for a vacuum cleaner filter bag comprising:

providing a base plate having a passage opening and providing a sealing flap for sealing the passage opening; and arranging an elastic element on the base plate or the sealing flap or both the base plate and the sealing flap, wherein the elastic element is arranged in front of the sealing flap when viewed in a sealing direction;

wherein the arranging of the elastic member comprises providing a coil spring, which is at least partially enclosed by a sheath.

* * * * *